United States Patent [19]

Tinker

[11] Patent Number: 4,508,486

[45] Date of Patent: Apr. 2, 1985

[54] VENTILATION FAN WITH NOISE-ATTENUATING HOUSING

[75] Inventor: Charles L. Tinker, Dover, Ohio

[73] Assignee: Peabody ABC Corporation, Warsaw, Ind.

[21] Appl. No.: 383,112

[22] Filed: May 28, 1982

[51] Int. Cl.[3] ..... F01D 5/26

[52] U.S. Cl. ..... 415/119; 415/197; 98/DIG. 10

[58] Field of Search ..... 98/39, 50, DIG. 10; 415/119, 197

[56] References Cited

U.S. PATENT DOCUMENTS 3,947,148 3/1976 Holt ..... 415/119

FOREIGN PATENT DOCUMENTS 2393960 9/1979 France ..... 415/119

10412 1/1979 Japan ..... 415/119

908521 10/1962 United Kingdom ..... 415/119

*Primary Examiner*—Philip R. Coe

*Assistant Examiner*—Frankie L. Stinson

*Attorney, Agent, or Firm*—Harvey C. Nienow

[57] ABSTRACT

In a high-speed, high-volume ventilation fan, a noise-attenuating housing structure includes a perforated inner casing contained within a solid-walled outer casing. Filling the space between the inner and outer casings is a porous, sound-absorbing material. To prevent loss of downstream pressure, and therefore operational efficiency, due to leakages of air through the sound-absorbing material from the downstream side at the fan blades to the upstream side thereof, an annular anti-flow barrier is situated in the space between the inner and outer casings slightly downstream of the fan blades. The structure thus provides a high degree of noise attenuation without sacrificing operational efficiency.

5 Claims, 4 Drawing Figures

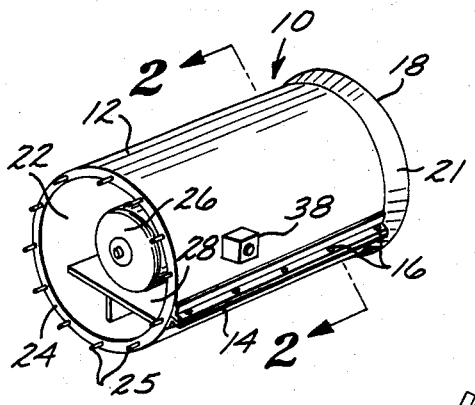
FIG. 1
FIG. 2
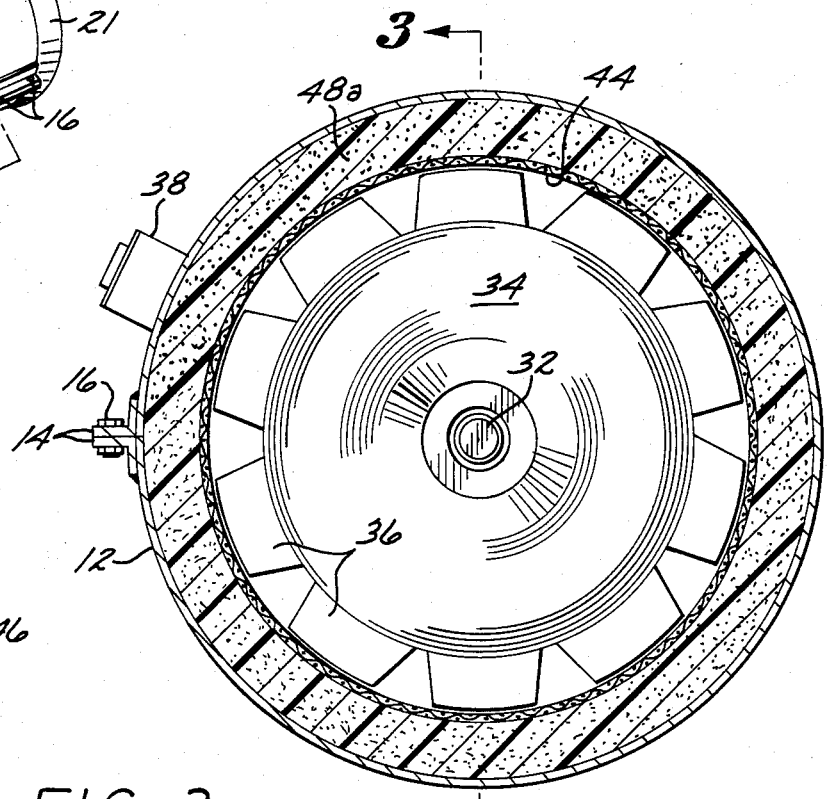
FIG. 4
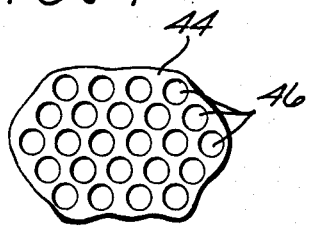
FIG. 3
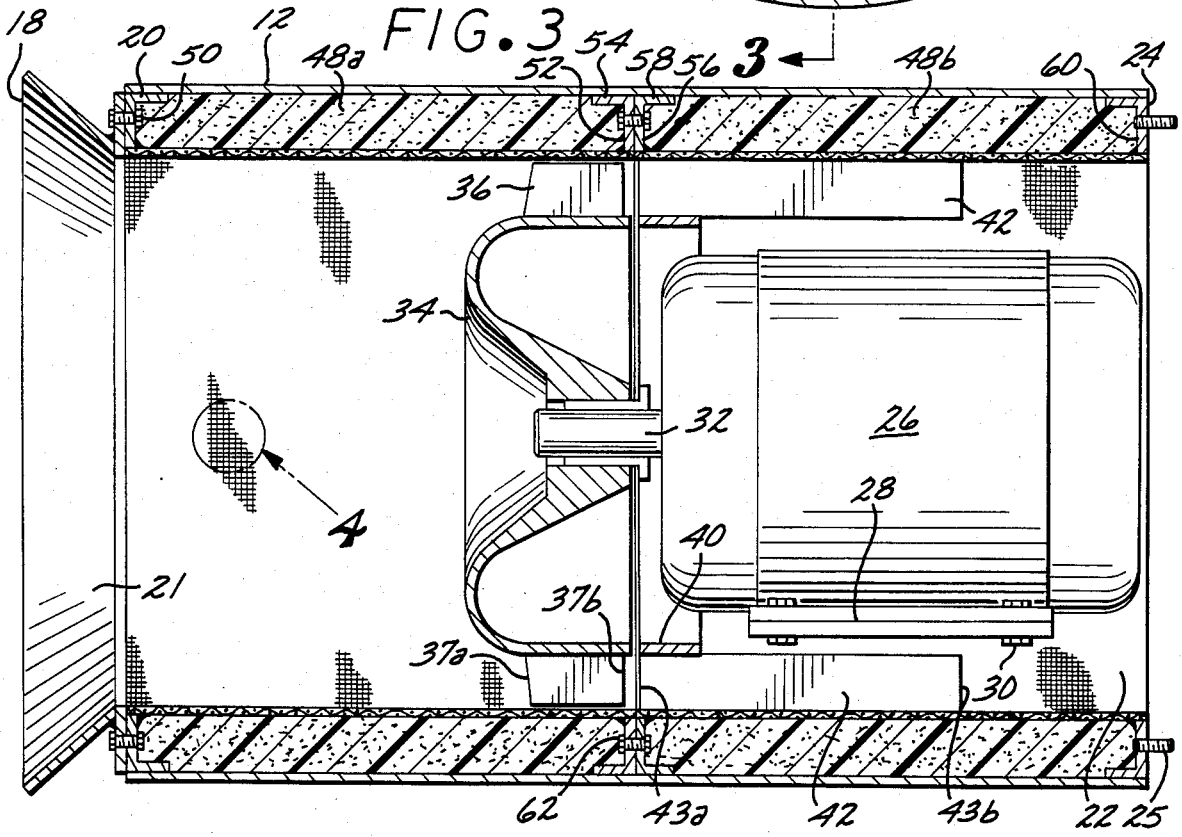

VENTILATION FAN WITH NOISE-ATTENUATING HOUSING

The present invention relates generally to the field of ventilation devices, and more particularly, to a housing structure for ventilation fans adapted for achieving high air flow rates.

In certain environments, rapid ventilation with large volumes of clean air is necessary to assure suitable standards of health and safety. Examples of such environments are deep-shaft mines, ocean vessel engine rooms, and chemical processing areas of industrial facilities.

To achieve the necessary ventilation, highly specialized fans have been developed which can move very large volumes of air in relatively short periods of time. Typically, such fans comprise a multi-bladed rotor driven by a relatively high-speed electric motor. The motor and the rotor are usually encased in a substantially tubular or cylindrical housing, with an open inlet end and an open outlet end.

There are two inter-related problems associated with such fans: Noise and efficiency. Because of the great speed with which the rotor is turned, relatively high noise levels are generated. Therefore, attempts have been made to provide acoustic damping in the housing structure. Typically, the acoustic damping is provided by a layer of sound-absorbing material, such as a porous foam, or a blanket of glass fibers sandwiched between a perforated inner housing member, or casing, and a solid-walled outer housing member or casing.

However, it has been found that due to the high dynamic pressures developed by these fans immediately downstream of the blades, air from the downstream air flow is forced through the porous sound-absorbing layer from the downstream side of the blades back to the upstream side of the blades. This counter flow of air diminishes the efficiency of the fan by decreasing the pressure differential through the fan unit. Since it is this pressure differential which is translated into air flow through the fan, it can be seen that any decrease in the pressure gradient or differential will result in reduced air flow for a given input of power to the rotor. With the efficiency thus reduced, the rotor must be driven faster than would otherwise be necessary (with optimal efficiency) to provide a given air flow, thereby exacerbating the noise problem.

Thus, there has been a recognized need for a sound-absorbing housing structure for such ventilation fans, which structure would not substantially degrade the operating efficiency of such devices. It is also recognized as desirable to provide such a structure which does not unduly increase the complexity or expense of such fans.

Broadly, the present invention is an improved noise-attenuating housing structure for ventilation fans and the like which comprises a perforated inner casing, a solid-walled (or "continuous") outer casing surrounding and concentric with the inner casing, a sound-absorbing medium sandwiched in the space between the inner and outer casings, and a solid annular barrier member in the space between the inner and outer casings, and so located therein as to be approximately coplanar with, or slightly downstream of, the downstream edges of the rotor blades of the fan encased in the inner casing.

More specifically, the inner and outer casings are substantially cylindrical in form, with the inner casing having open upstream and downstream ends. The sound-absorbing medium comprises a first layer of porous foam material extending from the downstream side of the barrier member to the downstream end of the inner casing, and a second layer of like material extending from the upstream side of the barrier member to the upstream end of the inner casing. The width of the annular barrier member is approximately equal to the width of the annular space defined between the inner and outer casings. In the preferred embodiment of the invention, the inner and outer casings are approximately of equal length, and the barrier member is located approximately at the mid-point of the co-extensive casing lengths. The rotor and its driving motor are mounted within the inner casing so that the downstream edges of the rotor blades are slightly upstream of the transverse plane defined by the barrier member, with the motor located on the downstream side of this plane.

As will be described more fully below, the construction and location of the barrier member is such that any flow of air which is introduced into the first (downstream) sound-absorbing layer is effectively blocked from entering the second (upstream) layer. The result is that the pressure gradient across the rotor is maintained, thereby increasing the efficiency of the fan, while at the same time, good noise attenuation characteristics are achieved.

Thus it will be appreciated that the present invention provides a relatively simple structure which uniquely reconciles the heretofore competing goals of noise attenuation and operational efficiency.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a perspective view of the exterior of the fan housing structure of the present invention, taken from the downstream, or outlet, end thereof;

FIG. 2 is a cross-sectional view taken substantially along line 2—2 of FIG. 1;

FIG. 3 is a longitudinal cross-sectional view taken substantially along line 3—3 of FIG. 2; and FIG. 4 is an enlarged, fragmentary view of the area in FIG. 3 enclosed by the broken outline and designated by the numeral 4.

Referring to the drawings, FIG. 1 shows the exterior of a ventilation fan having a housing 10 constructed in accordance with the present invention. As shown in FIGS. 1 and 2, the housing 10 has an outer casing 12 comprising a sheet of suitable metal configured in a generally tubular or cylindrical shape, with the edges attached to one another by a pair of longitudinal, right-angle brackets 14 secured by suitable means such as bolts 16. The housing 10 has an upstream or inlet end 18 defined by an upstream retaining ring 20, of right angle cross-section, to which is attached an outwardly-flared inlet member 21. The housing 10 has a downstream or outlet end 22 characterized by a downstream retaining ring 24, of right angle cross-section, and having means, such as bolts 25, for fastening the structure to a conduit or the like. A motor 26 is mounted on a platform 28 by suitable means, such as bolts 30.

As best shown in FIG. 3, the motor 26, mounted in the downstream side of the housing 10, has a shaft 32 coupled to a fan rotor 34 which carries a plurality of radially-extending fan blades 36, each having an upstream edge 37*a* and a downstream edge 37*b*. Power is advantageously supplied to the motor 26 via electric wires (not shown) fed through a fitting 38 on the housing 10. An annular cowling 40 may advantageously be provided around the upstream face of the motor 26 around the base of the shaft 32, downstream of the rotor 34, as shown in FIG. 3. A plurality of radially-extending guide vanes 42 may be mounted on the exterior surface of the cowling 40. Each of the vanes 42 has an upstream edge 43*a* and a downsteam edge 43*b*.

As shown in FIGS. 2 and 3, an inner casing 44 is provided which is concentric with the outer casing 12. The inner casing comprises a sheet of suitable metal, provided substantially throughout its length with multiple small, closely-spaced perforations 46 (FIG. 4), and configured in the generally tubular or cylindrical form illustrated. The diameter of the inner casing 44 is somewhat smaller than the diameter of the outer casing 12, so that an intercasing space is provided which is filled with sound-absorbing material, as will be presently described. (The diameter of inner casing 44 must obviously be large enough to provide suitable clearance for the distal ends of the fan blades 36.) It should be noted that the platform 28 on which the motor 26 is mounted is advantageously attached to the inner casing 44.

In the preferred embodiment shown, the inner casing 44 and the outer casing 12 are of substantially the same axial length, with substantially co-planar upstream and downstream terminations.

As best shown in FIG. 3, the aforementioned intercasing space is substantially filled, throughout its length and width, with a porous, non-flammable, sound-absorbing material, such as polyurethane foam, or glass fibers, for example. This sound-absorbing material is preferably installed in the form of a pair of tubular blankets or layers 48*a* and 48*b*. The layer 48*a*, which may be termed the "upstream" layer, has an annular upstream surface 50 seated against the upstream retaining ring 20, and an annular downstream surface 52 seated against a first median retaining ring 54, of right angle cross-section. Similarly, the layer 48*b*, which may be termed the "downstream" layer, has an annular upstream surface 56 seated against a second median retaining ring 58, also of right angle cross-section, and an annular downstream surface 60, seated against the downstream retaining ring 24.

The first and second median retaining rings 54 and 58, respectively, are fastened together back-to-back, as shown in FIG. 3, with means such as bolts 62. Thus assembled, the retaining rings 54 and 58 form, in conjunction with the outer casing 12 (against which they abut, as shown), a substantially air-tight annular barrier between the sound-absorbing layers 48*a* and 48*b*. The barrier defined by the retaining rings 54 and 58 should, preferably, define a plane traversing the interior of the housing just downstream of the downstream edges of the fan blades 36. If the device includes the guide vanes 42, the transverse plane defined by the barrier should lie between the downstream edges of the fan blades 36 and the upstream edges of the vanes 42. When the barrier is located in this manner, the downstream annular surface 52 of the upstream sound-absorbing layer 48*a* will lie approximately co-planar with the downstream edges 37*b* of the fan blades 36, while the upstream annular surface 56 of the downstream sound-absorbing layer 48*b* will lie approximately co-planar with the upstream edges 43*a* of the vanes 42. In the preferred embodiment of the invention, the motor 26, rotor 34, and vanes 52 are located in the housing such that when the aforementioned placement criteria are met, the barrier 54, 58 will be located approximately midway along the axial length of the housing, the aforementioned transverse plane thereby substantially bisecting the axial lengths of the casings.

While the precise location of the barrier 54, 58 is not overly critical, it should be so located as to block the flow of high-pressure air from the area downstream of the fan blades 36 back to the blades via the sound-absorbing layers 48*a* and 48*b*, as will be presently described.

In operation, the rotation of the rotor 34 and its blades 36 by the motor 26 creates a high-pressure, high-velocity stream of air downstream of the blades 36. Because of the porous nature of the sound-absorbing material, some of this high-pressure air flow leaks through the downstream sound-absorbing layer 48*b*. If the barrier 54, 58 were absent, this leaking air would flow from the downstream layer 48*b* to the upstream sound-absorbing layer 48*a*, and back into the vicinity of the fan blades 36. The backflow or re-circulation thus set up through the layers 48*a* and 48*b* would degrade the operational efficiency of the fan in the manner previously described.

However, with the barrier 54, 58 situated as described above, this counterflow is blocked before it can reach the blades 36. Thus, maximum pressurization is maintained downstream of the blades, thereby maximizing operational efficiency. With the fan thus allowed to operate at optimal efficiency, lower speeds are sufficient to obtain a given level of performance, thereby resulting in a lower level of noise. In addition, the use of the upstream sound-absorbing layer 48*a* further attenuates the level of noise escaping from the housing.

It should be noted that the above-described construction of the barrier 54, 58 is exemplary only, and suitable alternatives will suggest themselves to those skilled in the pertinent arts. For example, a solid, one-piece ring may be substituted for the two-piece assembly shown in FIG. 3. Whatever configuration the barrier might take, it should be of approximately the same width as the intercasing space in which it is situated, so as effectively to block air flow from the downstream sound-absorbing layer 48*b* to the upstream layer 48*a*.

There has thus been described a novel construction of a housing for a ventilation fan, in which a high degree of noise-attenuation is achieved without sacrificing operational efficiency. This achievement is brought about with a structure which is uncomplicated and economical of manufacture. Finally, the structure of the present invention may be readily modified, without departing from the spirit and scope of the invention, to accommodate fans of different sizes and configurations.

What is claimed is:

1. In a ventilation fan, of the type having a rotor with circumferentially spaced blades and means for driving said rotor, an improved housing structure, comprising:

a substantially cylindrical, perforated inner casing some of whose perforations said rotor and drive means therefor spaced radially from the distal ends of said blades;

a substantially cylindrical, substantially continuous outer casing concentrically surrounding said inner casing so as to define a substantially annular intercasing space between said inner and outer casings;

a porous, sound-absorbing medium substantially filling said intercasing space along substantially the entire length thereof for exposure to air moving through said space near said distal ends of said blades; and relatively thin annular barrier means intermediate the ends of said casings within said space adjacent said inner casing and in abutting relation to said sound-absorbing means on either side thereof, said barrier means extending from said inner casing to said outer casing to block the flow of air parallel to the length of said fan through said space adjacent said distal blade ends while enabling said sound-absorbing medium in abutting relation thereto to engage air flowing radially through said perforated inner casing from said blades.

2. The housing structure of claim 1, wherein said barrier means comprises a substantially solid annular barrier.

3. The housing structure of claim 2, wherein said barrier means is fixed to said outer casing and is formed with minimum thickness at said inner casing.

4. The housing structure according to claim 3 wherein said barrier means is positioned within said intercasing space substantially along a plane normal to the length of said fan.

5. In a ventilation fan according to claim 4 wherein said blades are aligned with each other on said rotor to have downstream edges which are aligned along a plane normal to the length of said fan, said housing structure having said barrier means substantially along said plane.

* * * * *